United States Patent [19]

Schlapman

[11] 4,204,293

[45] May 27, 1980

[54] DIFFERENTIAL UNIT

[75] Inventor: William J. Schlapman, Winneconne, Wis.

[73] Assignee: J. I. Case Company, Racine, Wis.

[21] Appl. No.: 19,933

[22] Filed: Mar. 12, 1979

Related U.S. Application Data

[63] Continuation-in-part of Ser. No. 924,199, Jul. 13, 1978, abandoned.

[51] Int. Cl.[2] ..... E01H 1/04; F16D 11/04

[52] U.S. Cl. ..... 15/79 R; 192/46

[58] Field of Search ..... 15/79 R, 79 A, 83; 192/46; 56/294

[56] References Cited

U.S. PATENT DOCUMENTS

| | | | |
|---|---|---|---|
| 336,728 | 2/1886 | Mack | 15/79 R |
| 604,812 | 5/1898 | Walton | 15/79 R |
| 907,755 | 12/1908 | Despain | 15/79 R |
| 1,984,966 | 12/1934 | Dohm | 192/46 X |
| 2,561,136 | 7/1951 | Richardson | 64/29 |
| 4,042,994 | 8/1977 | Sassaman | 15/79 R X |

FOREIGN PATENT DOCUMENTS

| | | | |
|---|---|---|---|
| 1127570 | 9/1968 | United Kingdom | 15/79 R |

*Primary Examiner*—Edward L. Roberts

*Attorney, Agent, or Firm*—Dressler, Goldsmith, Shore, Sutker & Milnamow, Ltd.

[57] ABSTRACT

A differential unit provides for relative movement between two drive wheels on a lawn sweeper or other implement powered by movement along the ground and includes a shaft and a pair of gears positioned transversely with respect to the shaft. A ratchet crown wheel is provided on one of the major faces of each gear and has camming surfaces for producing axial movement of the gears on the shaft, with each camming surface terminating in an axial surface. Axial movement is accommodated by a resilient member such as a coil spring. A roll pin projects outwardly from the shaft and engages an axial surface to drive the shaft, and is adapted to engage the camming surfaces to move the gear axially. The shaft is driven by the faster rotating gear, and difference in speeds of rotation of the gears produces a relative rotation of the shaft with respect to the slower rotating gear and produces axial movement of the slower gear with respect to the shaft.

11 Claims, 6 Drawing Figures

DIFFERENTIAL UNIT

REFERENCE TO RELATED APPLICATION

This application is a continuation-in-part of copending U.S. Ser. No. 924,199, filed July 13, 1978, now abandoned.

BACKGROUND OF THE INVENTION

The present invention relates to differential units for providing relative motion between two drive wheels.

Ground driven implements, such as lawn sweepers, have at least one pair of wheels which engage the ground. The wheels provide a positive drive for rotary brushes that are operably connected to the drive wheels by means of gears.

It is a particular problem with implements of this type that when rounding a corner or following a curved path, the outer wheel travels a greater distance than the inner wheel and locking or skidding of the wheels frequently results.

SUMMARY OF THE INVENTION

The present invention overcomes the foregoing problem by providing a differential unit for an implement, such as a rotary lawn sweeper, which has positive drive resulting from rotation of at least a pair of wheels along the ground.

The rotary sweeper has a pair of ground traversing drive wheels each having internal and external planetary gears concentric with the axis of the wheels. A rotary ground engaging brush is mounted on a shaft and has an axis of rotation parallel to the axis of the wheels and has a pair of pinion gears which mesh with one of the planetary gears. A second rotary brush is mounted on a shaft and has an axis of rotation parallel to the axis of the wheels and above the plane of the ground engaging brush and has a pair of pinion gears meshing with the other of the planetary gears. The planetary gears provide the brushes with a positive drive in opposite directions for propelling particulate material to a collection hopper.

The differential unit is supported by and secured to opposite ends of at least one of the shafts. The differential unit associated with each shaft comprises a pair of pinion gears which each have a pair of opposing major faces and are positioned transversely with respect to that shaft and are supported by the shaft. Ratchet crown means is provided on at least one of the major faces of each of the pair of pinion gears. The ratchet crown means has camming surfaces for producing axial movement of the pinion gears on the shaft, and each of the camming surfaces terminates in an axial surface. Means is provided for accommodating axial movement of the first pinion gears on the shaft. Projecting means protrude radially outwardly from the shaft adjacent to the ratchet crown means and are adapted to engage one of the axial surfaces to drive the shaft, and are adapted to engage one of the camming surfaces to move the pinion gears axially. Differences in speeds of rotation of the pinion gears will thereby produce relative motion of the shaft with respect to the slower rotating pinion gear and produce axial movement of the slower gear with respect to the shaft.

In one embodiment of the invention, a sleeve or mounting cup is telescoped over each end of the shaft and has a flange protruding radially outwardly therefrom on one side of each of the pinion gears, and the means accommodating axial movement is a resilient means overlying a portion of each sleeve between the flange and one of the major faces of each of the first pinion gears, and the ratchet crown means is on the opposite major face of each of the pinion gears.

It is also preferred to have the sleeves held on the shaft by the projecting means which are preferably a pair of roll pins, with one of the roll pins being associated with each of the pinion gears.

In this embodiment of the invention, the shaft does not have to be as strong as is required for conventional implements wherein the gear is connected directly to the shaft, because the gear is engaged only by a roll pin which is secured to the shaft. Moreover, there is less wear to the shaft than otherwise occurs with conventional implements. In addition, only the gear and the sleeve, and not the shaft, become worn and require replacement.

In the modified form of the invention, the sleeve is eliminated and the gear is supported directly on the shaft.

It is a feature of the present invention that two or more gears can be connected to a live axle or shaft and to corresponding drive wheels, will turn independently of one another proportionate to the rate of rotation of the corresponding drive wheels, and the shaft will turn at the rate of the faster rotating gear. This can be accomplished with a minimum number of components in the drive system. It is particularly advantageous that the shaft is rotated at the speed of the faster rotating gear.

DETAILED DESCRIPTION OF THE PREFERRED EMBODIMENT

Figure 1:
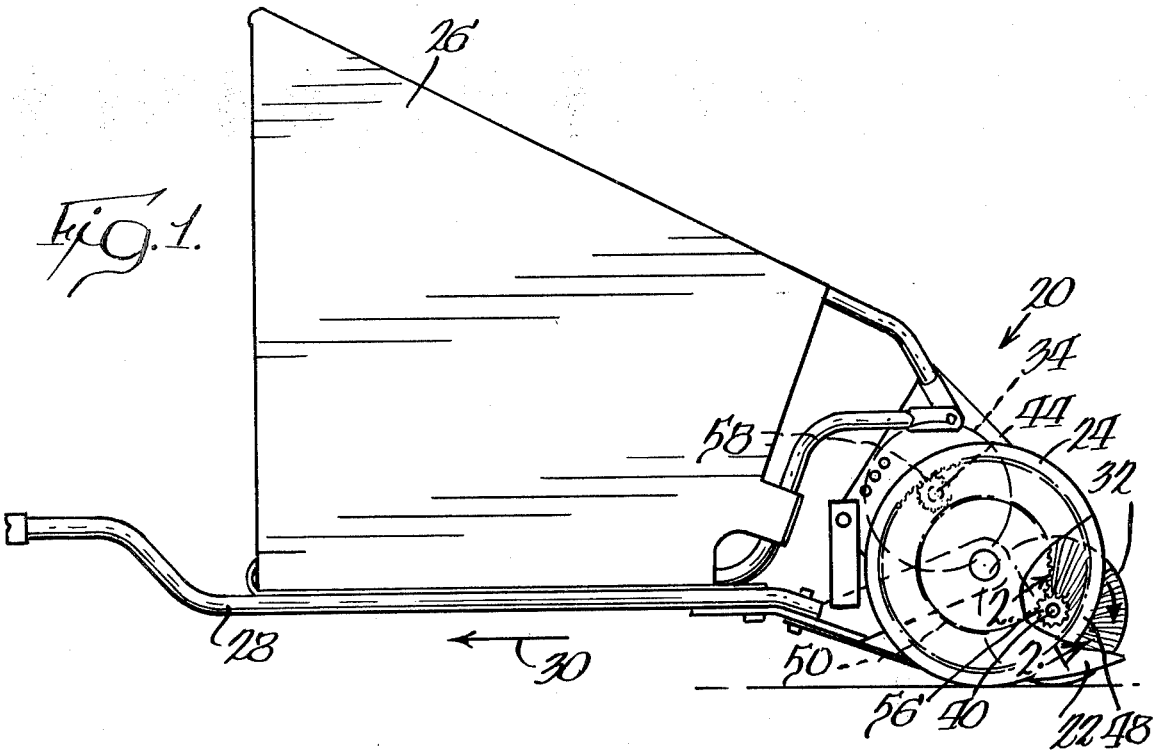
FIG. 1 is a side view, partially cut-away to show interior details of the sweeper assembly and differential unit of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

The differential unit 10 of the present invention provides for relative motion between two drive wheels, and is particularly suitable for use with ground driven implements, such as lawn sweepers as depicted in FIG. 1.

Referring to FIG. 1, the disclosed embodiment of the sweeper assembly 20 includes an enclosed housing 22, ground engaging and supporting wheels 24, a collection hopper 26 and a draw bar assembly 28. As described below, the draw bar assembly may be connected to a tractor or other vehicle to pull the sweeper assembly along the ground in the direction of arrow 30.

The sweeper assembly further includes a rotary ground engaging or sweeper brush 32 and a second rotary brush 34 located adjacent and above the sweeper brush 32 within the housing. As the sweeper assembly is drawn along the ground, the brushes are caused to rotate in opposite directions to lift leaves, grass and other debris, which is propelled into the hopper 26. The sweeper brush 32 lifts the debris from the ground and the second rotary brush 34 propels the debris into the hopper. The second rotary brush 34 preferably rotates at a greater speed than the ground engaging brush 32, such that the debris picked up by the ground engaging brush does not accumulate between the brushes and the material is propelled into the hopper, as described hereinbelow.

The construction of the sweeper is described in detail in commonly assigned U.S. Pat. Nos. 4,037,284 to McDonald and 3,823,435 to Rhodes et al., which are incorporated by reference herein. Briefly, the housing 22 includes forward, rearward and sidewalls which define an open ended closure. The forward and rearward walls define an hourglass configuration which provides baffling for the brushes. The sweeper brush 32 is rotatably supported within the housing on shaft 40, and the second rotary brush 34 is rotatably supported on shaft 44. Brush 34 is located forward and above sweeper brush 32 within the housing enclosure. "Forward" refers to the direction of movement of the sweeper, as shown by arrow 30. Movement of the sweeper in the direction of arrow 30 rotates the sweeper brushes in opposite directions; sweeper brush 32 is rotated in a clockwise direction to sweep particulate material upwardly into the housing enclosure, and the second rotary brush 34 is oppositely rotated in a counterclockwise direction to propel the particulate material into the hopper 26.

Figure 2:
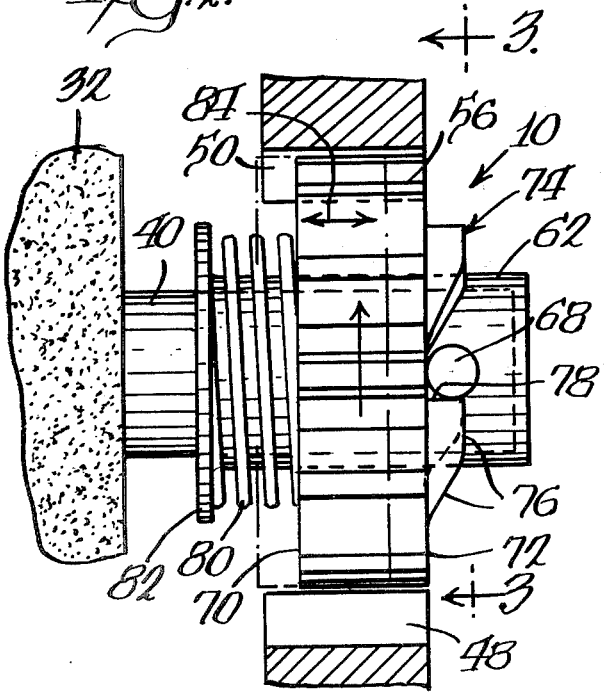
FIG. 2 is a cross-sectional view taken along line 2—2 of FIG. 1.

The sweeper assembly includes a positive drive for the brushes, as described in the above-referenced patents. Briefly, the wheel 24 includes a hub (not shown) having a central portion encircling the axis of the wheel. The hub includes an annular channel which is concentric with the axis of the wheel. As shown in FIG. 2, the radial outer wall of the channel includes an internal planetary gear 48 and the radial inner wall of the channel includes an external planetary gear 50.

In the disclosed embodiment, the shaft 40 of the sweeper brush 32 includes pinion gear 56, near the distal ends of the shaft, which is received within the channel and meshes with the external planetary gear 50 to provide a positive drive for the sweeper brush 32. Similarly, the shaft 44 of the second rotary brush 34 includes pinion gear 56 which is received within the annular channel and meshes with the internal planetary gear 48.

The planetary gears therefore provide a positive drive for both of the brushes. The brushes are rotated in opposite directions because the sweeper brush is driven by the external planetary gear 50 and the second rotary brush is driven by the internal planetary gear 48. Further, the second rotary brush 34 is driven at a slightly greater speed than the sweeper brush 32 because the outer wall of the channel, including the internal planetary gear, rotates in teeth per second at a slightly greater speed than the external planetary gear. Other details of the positive drive are more fully disclosed in the above referenced patents.

A problem with drive assemblies for prior art sweepers is the occurrence of locking or skidding of the wheels when the sweeper is towed in a curve such that the wheels operate at different speeds, i.e., the inside wheel moves slower than the outside wheel. Where each sweeper brush is on a single live axle or shaft, which is driven by a pair of gears on opposite ends of the shaft that are operably connected to the drive wheels, the gears will rotate at different speeds whenever the drive wheels rotate at different speeds, as when rounding a curve. If both gears were connected directly to the shaft, locking or skidding of the wheels would occur.

The present invention overcomes these problems while having a single live shaft operably connected to both gears and which always rotates at the speed of the faster rotating gear.

Figure 3:
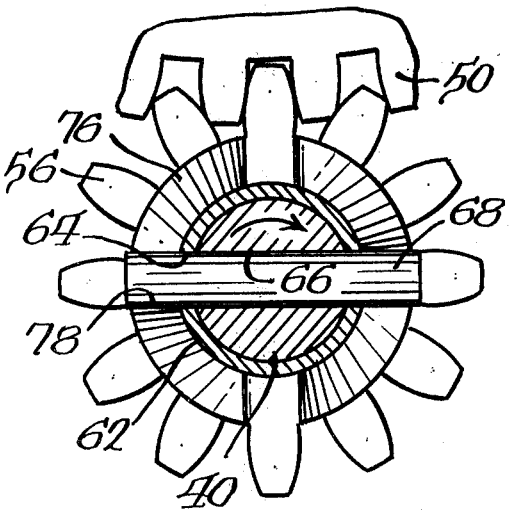
FIG. 3 is a partially cross-sectional view taken along line 3—3 of FIG. 2.

In accordance with the present invention, a differential unit 10 which is shown in FIGS. 2 and 3 provides for relative motion between the drive wheels. The differential unit 10, as shown in FIGS. 2 and 3, is depicted in relation to shaft 40, and preferably would be provided as well for shaft 44 and any other shaft operably connected to the drive wheels 24.

The differential unit includes a sleeve or mounting cup 62 which is supported by and is secured to opposite ends of the shaft. Each sleeve may be cup-shaped (FIG. 2) and telescoped over the end of the shaft. The intermediate portion of the sleeve has diametrically opposed generally cylindrical openings 64 which can be aligned with a cylindrical opening 66 that is defined by shaft 40 and extends transversely through the shaft (FIG. 3). A projecting means, such as generally cylindrical roll pin 68, is inserted through openings 64 and 66 to secure the sleeve 62 to the shaft 40, and protrudes radially outwardly from the shaft 40, as shown in FIG. 3.

Each pinion gear 56 is positioned transversely with respect to the shaft and is supported by a portion of the shaft 40 and sleeve 62. Each gear has a pair of opposing major faces 70 and 72 and is operably connected to one of the drive wheels by means of external planetary gear 50.

The differential unit further includes ratchet crown means 74 on at least one of the major faces of each gear. As illustrated in FIG. 2, the ratchet means is on face 72 of the gear 56 and is integral with the gear. The ratchet crown means has a plurality of camming surfaces 76 which each terminate in an axial surface 78. As shown in FIG. 2, camming surfaces 76 include the entire raised portions of the ratchet crown means. There is a space between each axial surface and the beginning of the next camming surface to accommodate the roll pin 68, which is positioned adjacent to the ratchet crown means 74 and is adapted to engage an axial surface 78 to drive the shaft, or to engage a camming surface 76 to move the gear 56 axially relative to the shaft 40, as explained hereinbelow.

The opposed major face 70 of each gear 56 is a generally flat surface extending radially of the axis with resilient means between the shaft and flat surface. Preferably, the resilient means is a coil spring 80 which is telescoped over the sleeve 62 and accomodates axial movement of the gear 56. The sleeve 62 has a flange 82 protruding radially outwardly therefrom, and the coil spring 80 engages the flange 82 and flat surface 70 of the gear 56. The roll pin 68 is positioned on one side of the gear, and the coil spring 80 is positioned on the opposite side of the gear in the disclosed embodiment.

The coil spring is movable between the compressed condition shown in FIG. 2 and a more compressed condition. Thus, the coil spring biases gear 56 such that roll pin 68 is aligned with and engages one of the axial surfaces 78 to drive the shaft 40 at the rate of rotation of the faster rotating gear 56. When the gear 56 is rotating slower than the shaft 40, the gear rotates relative to the shaft, and a camming surface 76 engages the roll pin 68, thereby producing relative rotation of the slower rotating gear with respect to the shaft to the position shown in phantom in FIG. 2 in which the coil spring is in a more compressed condition. The roll pin will engage the camming surfaces, and the gear will move back and forth in the direction of arrows 84 along the axis of the shaft, and the coil spring accommodates the movement by alternating between its compressed condition and the more compressed condition. This back and forth movement continues until the shaft 40 and gear 56 rotate at the same speed, at which time the roll pin 68 is in engagement with one of the axial surfaces 78 to drive the shaft.

FIG. 2 shows the portion of the differential unit at one end of the shaft. A like arrangement is provided at the opposite end of the shaft, and another differential unit would be provided on shaft 44 for rotary brush 34. Accordingly, for each shaft, there would be a pair of gears at opposite ends of the shaft, and a sleeve, roll pin, and coil spring would be associated with each gear.

In the embodiment so far described, the sleeve or mounting cup can be a precision formed component which acts as an adapter, a bearing, a positioner and a retainer for the gear, the coil spring and the retainer elements. Since all of the movable components are supported on the peripheral surface of the mounting cup or sleeve, a lower grade of shaft material can be utilized and need not be machined to close tolerance to accommodate the axial movement of the gear on the shaft.

Figure 4:
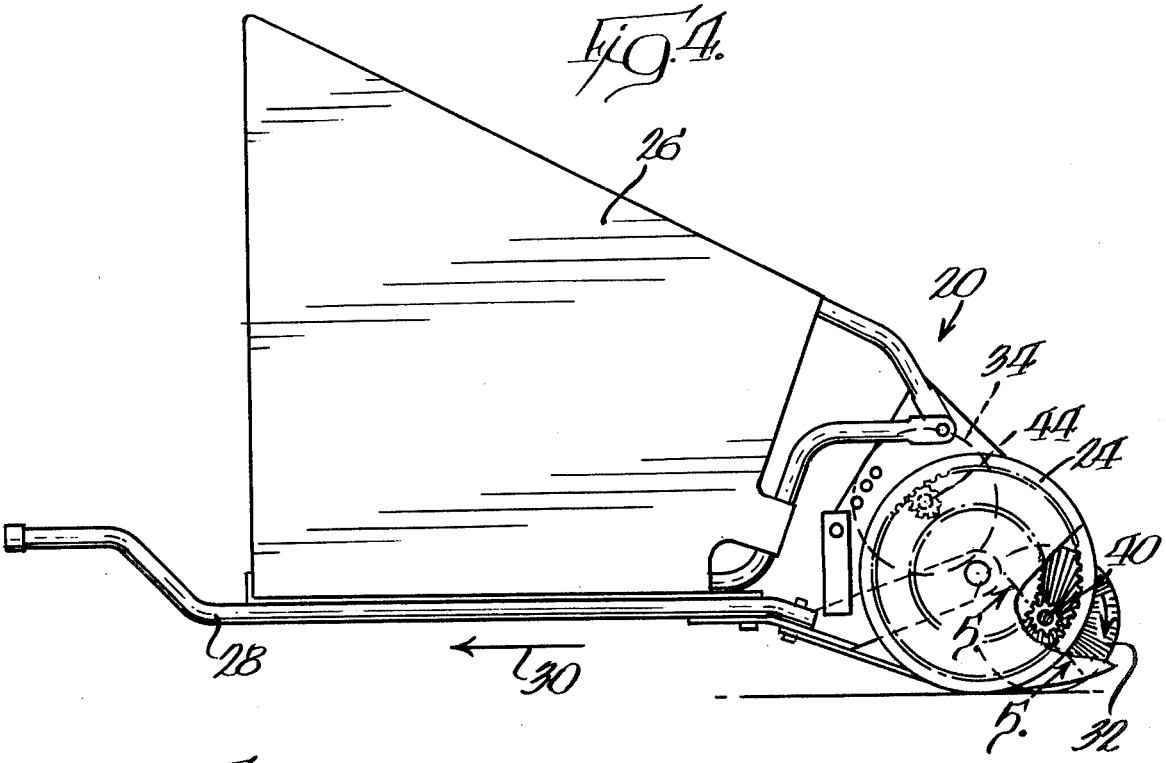
FIG. 4 is a side view similar to FIG. 1 showing a modified form of differential unit.
Figure 5:
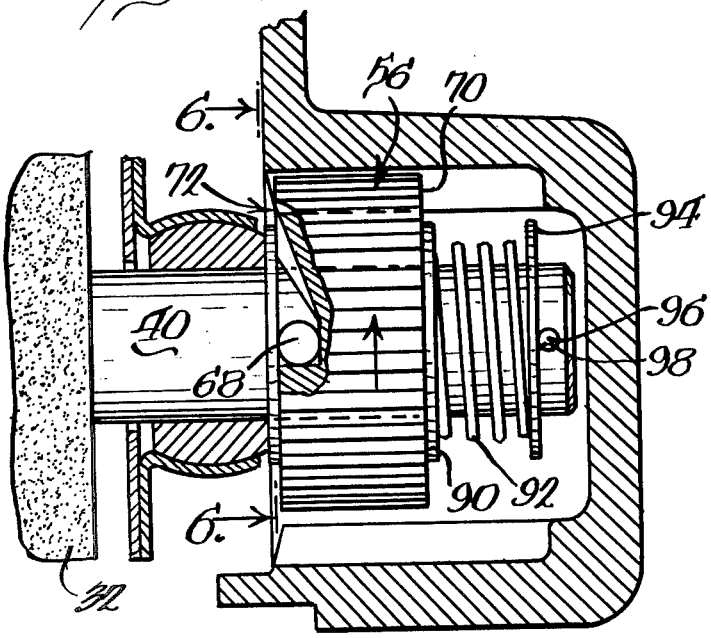
FIG. 5 is a cross-sectional view taken along line 5—5 of FIG. 4.
Figure 6:
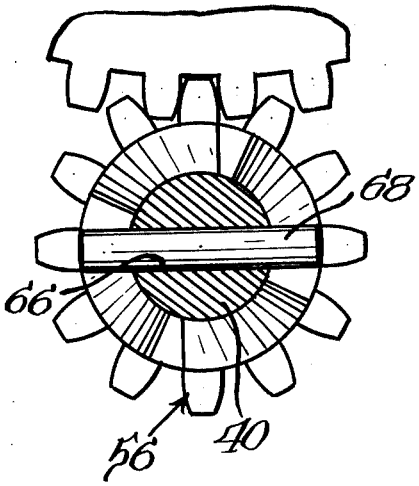
FIG. 6 is a cross-sectional view taken along line 6—6 of FIG. 5.

A slightly modified and simplified form of the invention is illustrated in FIGS. 4–6 and all of the components described in connection with FIG. 1 are identical and need not be repeated at this time. In the modified form of the invention, the same type of gear 56 is utilized on shaft 40 or 44. Since only the manner of supporting the gear for axial movement on the shaft is different, only this portion of the modified form of the invention will be described in detail utilizing shaft 40 and gear 56 as exemplary with the understanding that each gear will be mounted on each end of each shaft in an identical manner.

As illustrated in FIG. 5, gear 56 has a ratchet crown means on major face 72 which is directed towards the center of the shaft and is axially shiftable directly on the shaft. Roll pin 68 extends through an opening 66 which extends radially through the center of shaft 40 and pin 68 is located adjacent major face 72. The opposite major face, which defines a generally flat surface extending radially of the axis of shaft 40, is directed towards the free end of the shaft. A first washer 90 is telescoped over the free end of the shaft 40 and a coil spring 92 has one end in engagement with washer 90. A further washer 94 is telescoped over the outer end of shaft 40 and engages the opposite end of coil spring 92. A pin 96 extends through an opening 98 at the outer end of shaft 40 and extends from the periphery of the shaft to retain washer 94 on the shaft and also maintains the coil spring in a compressed condition at all times. The pin 96 and washer 94 may be considered to define an abutment means on the end of shaft 40 for biasing means or spring 92. In this simplified embodiment of the invention, the operation of the differential drive unit is identical to that described above.

In both embodiments of the invention, the particular configuration of each pinion gear simplifies the construction of the gear and thereby reduces the cost for the entire assembly. Since one of the major faces is a flat surface, the gear can readily be formed on automatic presses and the flat surface allows for the finished gear to be removed from the press through a movable arm. Since only a single gear is defined on one major surface, the dimensional relationships of the various components need not be retained within any close tolerance. Also, since the driving relationship between the shaft and the gear is an inexpensive pin, replacement of the component can be done at minimal cost.

In accordance with the present invention, ratchet crown means having axially extending camming surfaces is provided on at least one major face of each gear while the other major face is flat, and the gear moves axially and rotatably relative to the shaft when the gear rotates slower than the shaft, with the axial movement being limited and accommodated until the gear and shaft again rotate at the same speed. With this arrangement, the shaft is always rotated by the faster driven gear, so that maximum power is always provided to the sweeper. The differential action is accomplished with a minimum number of parts, and the gear and spring are anchored to the shaft by a single roll pin. Also, by having the differential unit at opposite ends of the shaft, skidding of wheels is eliminated, which thereby reduces wear of the wheels.

What is claimed is:

1. A differential unit providing for relative motion between two drive wheels, comprising: a shaft, a pair of gears positioned transversely with respect to said shaft and supported by said shaft, each of said gears having a pair of opposing major faces and being operably connected to one of said drive wheels, ratchet crown means on only one of said major faces of each gear and having camming surfaces for producing axial movement of said gears on said shaft, each of said camming surfaces terminating in an axial surface, the other of said major faces defining a generally flat surface extending radially of said shaft, projecting means protruding radially outwardly from said shaft adjacent to said ratchet crown means and adapted to engage an axial surface to drive said shaft and to engage said camming surface to move said gears axially, abutment means carried by said shaft adjacent to and spaced from each ratchet crown means, and biasing means between said abutment means and said flat surfaces biasing said camming surfaces toward said projection means, whereby differences in speeds of rotation of said gears will produce relative rotation of said shaft with respect to the slower rotating gear and compress said biasing means to produce axial movement of said slower gear with respect to said shaft.

2. A differential unit as defined in claim 1, in which each end of said shaft has a mounting cup telescoped thereon and releasably retained thereon by said projecting means with said gears respectively telescoped on said mounting cups, each mounting cup having a radial flange extending from an inner end thereof and defining said abutment means.

3. A differential unit as defined in claim 1, in which said flat surface of each gear is located adjacent each end of each shaft and each abutment means includes a washer telescoped over the end of said shaft and a radial pin extending from said shaft and retaining said washer on said shaft.

4. A differential unit providing for relative motion between two drive wheels, comprising: a shaft, a mounting cup telescoped on each end of said shaft and respectively secured to opposite ends of said shaft, a pair of gears positioned transversely with respect to said shaft and respectively telescoped on said mounting cups, each of said gears having a pair of opposing major faces and being operably connected to one of said drive wheels, said mounting cups each having a flange protruding radially outwardly therefrom on one side of each gear, projecting means protruding radially outwardly from said mounting cup on the opposite side of each gear, ratchet crown means on one of said major faces of each gear and having camming surfaces which each terminate in an axial surface, resilient means supported by a portion of said mounting cup between said flange and the other major face of each of said gears, said resilient means biasing each of said gears such that said projecting means engages one of said axial surfaces for driving said shaft at the rate of rotation of the faster rotating gear, whereby differences in speeds of rotation of said gears will produce relative rotation of said shaft with respect to the slower gear and produce axial movement of said slower gear with respect to said shaft by having said projecting means engage one of said camming surfaces on said slower gear thereby compressing said resilient means associated with said slower gear.

5. A differential unit as defined in claim 4, wherein each mounting cup is secured to said shaft by means of said projecting means.

6. A differential unit as defined in claim 4, wherein said resilient means comprises a pair of coil springs, one of said springs being associated with each of said gears.

7. A differential unit as defined in claim 4, wherein said ratchet crown means is integral with said gears.

8. A differential unit providing for relative motion between two drive wheels comprising: a shaft, a pair of gears telescoped on opposite ends of said shaft, each gear having opposed major faces, ratchet crown means integral with one major face defining circumferentially spaced camming surfaces for producing axial movement of said gears on said shaft, each of said camming surfaces terminating in an axial surface, the other of said major faces of each gear defining a generally flat surface extending radially of said shaft, a pin carried by and projecting from said shaft adjacent said ratchet crown means, and biasing means between each flat surface and said shaft biasing said camming surfaces into engagement with said pin.

9. A differential unit as defined in claim 8, in which each biasing means includes a spring telescoped over the end of said shaft and engaging said flat surfaces, a washer telescoped over said shaft and a pin retaining said washer on said shaft and maintaining said spring in a compressed condition.

10. A rotary sweeper assembly comprising a pair of ground traversing drive wheels, a rotary ground engaging brush mounted on a shaft and having an axis of rotation parallel to the axis of said wheels and having a pair of gears operably connected to said drive wheels, a secondary rotary brush mounted on a shaft and having an axis of rotation parallel to the axis of said wheels and above the plane of said ground engaging brush and having a pair of gears operably connected to said drive wheels, said gears providing said brushes with a positive drive in opposite directions for propelling particulate material to a collection means, said gears associated with each of said shafts having a pair of opposing major faces and being positioned transversely with respect to said shaft and supported by said shaft, ratchet crown means on at least one of said major faces of each of said gears and having camming surfaces for producing axial movement of said gears on each of said shafts, each of said camming surfaces terminating in an axial surface, the other of said major faces defining a flat surface extending radially of said shafts, projecting means protruding radially outwardly from said shafts adjacent each ratchet crown means and adapted to engage one of said axial surfaces to drive said shafts and to engage said camming surface to move said gears axially, and biasing means between said shafts and each flat surface biasing each ratchet crown means into engagement with each projecting means, whereby differences in speeds of rotation of said drive wheels results in different speeds of rotation of said gears on each shaft and will produce relative rotation of each of said shafts with respect to the slower rotating gear on each shaft to compress said biasing means and produce axial movement of each of said slower gears with respect to each of said shafts.

11. A rotary sweeper assembly as defined in claim 10, further including a sleeve on each end of each shaft, each sleeve having a flange protruding radially outwardly therefrom on one side of each of said gears, and said projecting means includes a pin extending through said sleeve and said shaft to retain said sleeve on said shaft.

* * * * *